United States Patent [19]

Granberg et al.

[11] 4,070,757

[45] Jan. 31, 1978

[54] LOG SAWING ATTACHMENT FOR A CHAIN SAW

[75] Inventors: Elof Granberg, San Rafael, Calif.; Emil Adolph Olsen, North Burnaby, Canada

[73] Assignee: Granberg Industries, Richmond, Calif.

[21] Appl. No.: 739,509

[22] Filed: Nov. 8, 1976

[51] Int. Cl.[2] ..... B27B 17/02; B27B 27/02

[52] U.S. Cl. ..... 30/371; 83/745

[58] Field of Search ..... 30/166, 371, 372, 373, 30/375, 382; 83/745

[56] References Cited

U.S. PATENT DOCUMENTS

| | | | |
|---|---|---|---|
| 3,026,918 | 3/1962 | Dooley | 30/371 |
| 3,051,203 | 8/1962 | Hayden | 30/371 |
| 3,225,799 | 12/1965 | Hayden | 30/371 |
| 3,864,830 | 2/1975 | Haddon | 30/371 |
| 3,965,788 | 6/1976 | Granberg | 83/745 |

*Primary Examiner*—Jimmy C. Peters

*Attorney, Agent, or Firm*—Bruce & McCoy

[57] ABSTRACT

A log sawing attachment for a chain saw which includes a moveable guide frame which can be clamped to the cutter bar of the chain saw and can be variably spaced therefrom. The frame guides the chain saw to make pre-selected depth of cut along the log being sawed to form a uniform thickness board.

10 Claims, 3 Drawing Figures

LOG SAWING ATTACHMENT FOR A CHAIN SAW

BACKGROUND OF THE INVENTION

1. Field of the Invention

The present invention relates to lumber sawing devices and more particularly to a log sawing attachment for a chain saw for cutting uniform thickness boards.

2. Description of the Prior Art

While several lumber making attachments for chain saws have been devised, the most closely related device to the present invention is that taught by U.S. Pat. No. 3,225,799 to E. A. Hayden, et al. for a LUMBER SAWING ATTACHMENT FOR PORTABLE CHAIN SAW issued Dec. 28. 1965. That device was manufactured for many years by the present inventor's company and proved to have numerous defects which made it uneconomical to sell.

In operating the Hayden device, a flat cut is effected in a log by first nailing a board to the top of the log and then guiding the rollers along the top of the log to make a flat cut through the wood. Thereafter the rollers are rolled along the flat cut to effect the next lower flat cut. This process is repeated until the whole log has been cut into boards. The thickness of the cut can be adjusted simply by turning the hand wheels to move the rollers closer to or away from the cutter bar of the chain saw.

One of the biggest problems with the Hayden device is that the rollers which were intended to permit the saw to effect a straight cut through the wood did not achieve that result. The rollers would, when traversing the log, roll up and over any sawdust encountered on the top of the log rather than pushing it aside and thereby caused an irregular cut through the log as a result of the sawdust bumps being traversed.

Another major defect with the device was the cost of manufacture. It had too many machined parts which simply priced it out of the marketplace. The rollers were heavy and expensive; the screw threads were too expensive to make; the edge guide rollers were too expensive; the whole machine proved impractical from an economic point of view.

The Hayden device required the saw bar of the chain saw to be drilled in order to mount the attachment of the chain saw. This disadvantage proved a sales block for the reason that users in the field simply wanted to easily mount the device on the chain saw and did not care to provide the facilities for modifying the cutter bar in order to secure the attachment to it.

Other problems during the manufacture and use of the device caused it to be virtually an unsaleable machine. In order to overcome these defects a completely new design was required.

SUMMARY OF THE INVENTION

The present invention is a log sawing attachment for a chain saw. It includes a pair of clamping means for engaging opposite ends of the cutter bar of the chain saw. Each of the clamping means is formed with a pair of locking bars which extend beyond the edges of the cutter bar and saw chain and are adjustably interconnected at their opposite ends outside the chain path. This arrangement permits the locking bars to be drawn together to clamp the chain saw cutter bar therebetween.

A pair of support posts are provided and each of the posts is secured to one of the clamping means. Both of the support posts are disposed to project perpendicularly from the cutter bar on the same side thereof.

A guide frame is provided which is adjustably mounted on the support posts by means of clamps. The guide frame is for the purpose of guiding the chain saw to cut at a preselected depth in the log being sawed. The guide frame includes a pair of flat bottomed surface engaging members having their bottom surfaces disposed in a plane parallel the cutter bar. These flat bottom surfaces slide along the flat surface being used to guide the chain saw during the saw cut. The surface engaging members are interconnected by a pair of spreaders and disposed in parallel relation on opposite sides of a plane formed between the support posts. The spreaders are adjustably clamped to the support posts to permit variable spacing of the guide frame with respect to the chain saw cutter bar.

A guide fence is provided which is secured to the clamping means disposed at the drive end of the cutter bar to guide the chain saw along the side of the log as the board is being cut. A handle is secured to the guide frame at the race end of the cutter bar to permit a second operator to grasp the attachment and help guide and pull the chain saw through the cut.

OBJECTS OF THE INVENTION

It is therefore an important object of the present invention to provide a log sawing attachment which guides a chain saw to make a very straight flat cut through a log.

It is another object of the present invention to provide a strong but lightweight log sawing attachment for a chain saw.

It is a further object of the present invention to provide a log sawing attachment for a chain saw which is relatively inexpensive to manufacture and in large part utilizes parts cut from lengths of uniform cross-section extrusions.

It is still another object of the present invention to provide a log sawing attachment for a chain saw which does not require the previous cut through the log to be swept clear of sawdust.

And it is yet a further object of the present invention to provide a log sawing attachment for a chain saw which can be mounted directly on the cutter bar on the chain saw without any modification of the cutter bar or to the chain saw as such.

Further objects of the present invention will become apparent when the description of the preferred embodiment is considered in conjunction with the accompanying drawings.

DESCRIPTION OF THE PREFERRED EMBODIMENT

The log sawing attachment of the present invention includes a pair of clamping means 12 for engaging opposite ends of the cutter bar 14 of a chain saw. The cutter bar is the guide track for the saw chain and it projects outward from the saw chain drive motor. Each of the clamping means is formed with a pair of locking bars 16, 18 which are of a length to extend beyond the edges of the cutter bar and the saw chain when the locking bars are disposed transversely and parallel to the cutter bar.

Figures 1, 2:
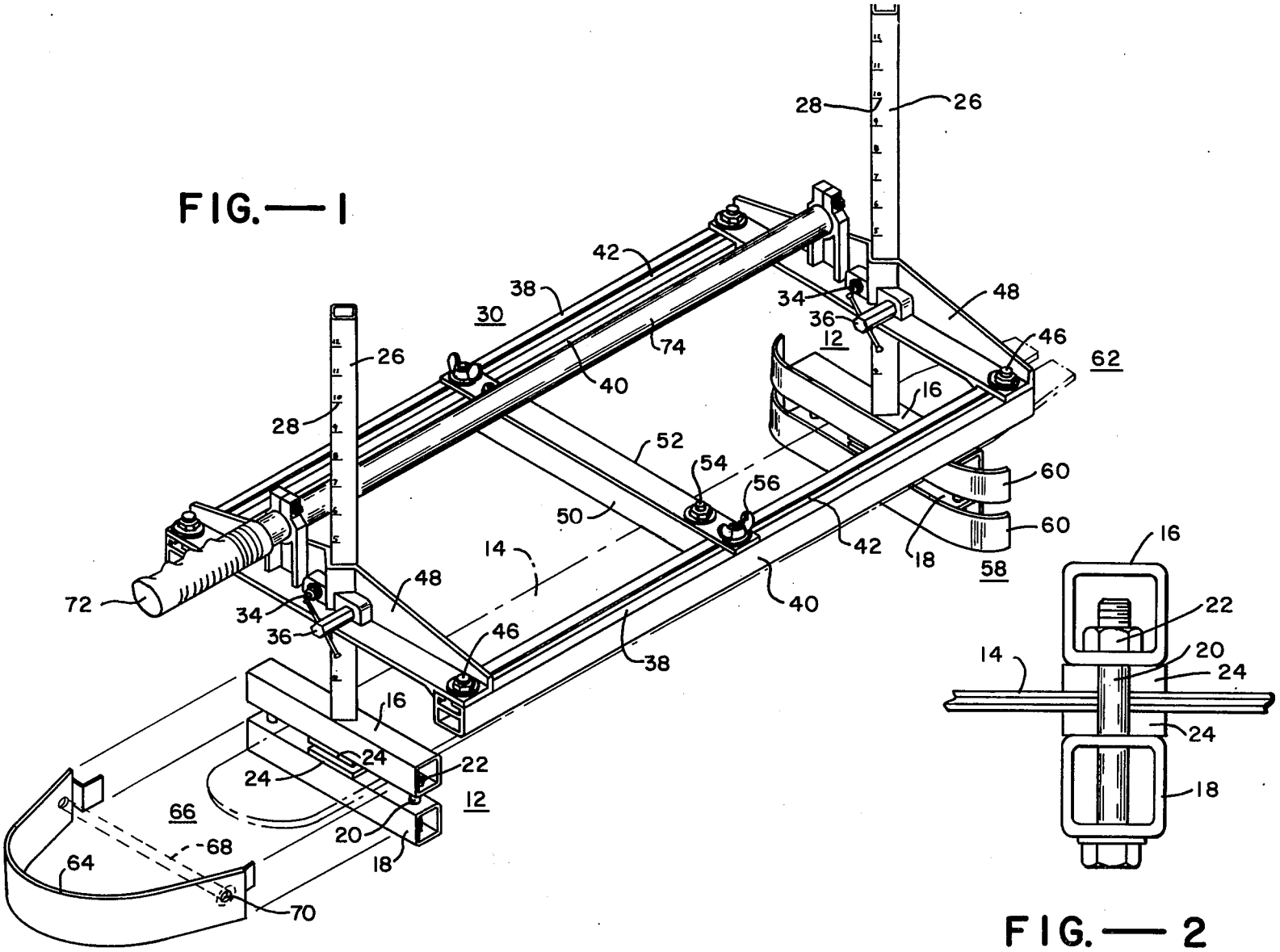
FIG. 1 is a perspective view of the present invention.
FIG. 2 is a partial side elevation of the present invention.

In the preferred embodiment, the locking bars 16, 18 are adjustably interconnected at their opposite ends outside of the chain path by means of bolts 20. This adjustable interconnection permits the locking bars to be drawn together to clamp the chain saw cutter bar 14 between the locking bars. In the preferred embodiment, the locking bars are square tubular members cut from a length of uniform cross section extruded material, and as a result of this design, they can be cheaply made. The bolts 20 used for interconnecting the locking bars can be of a selected length to permit the nut 22 on the bolt to be enclosed within one of the locking bars as shown in FIG. 2. This arrangement affords neatness of design and protects the chain saw operator from the threaded portion of the bolt.

The locking bars 16, 18 include pressure or clamping pads 24 which are secured to the locking bars intermediate the ends thereof and on opposing surfaces. These pads permit the locking bars to clamp or grip the chain saw cutter bar 14 therebetween. The thickness of the pads also spaces the locking bars to provide clearance for the saw chain to pass between the locking bars as it travels around the cutter bar.

A pair of square tubular support posts 26 having corresponding indicia 28 printed thereon are secured to the clamping means 12. Each of the posts is secured to one of the locking bars 16, 18 of each of the pair of clamping means, and the posts are disposed to project perpendicularly from the cutter bar 14 on the same side thereof.

Figure 3:
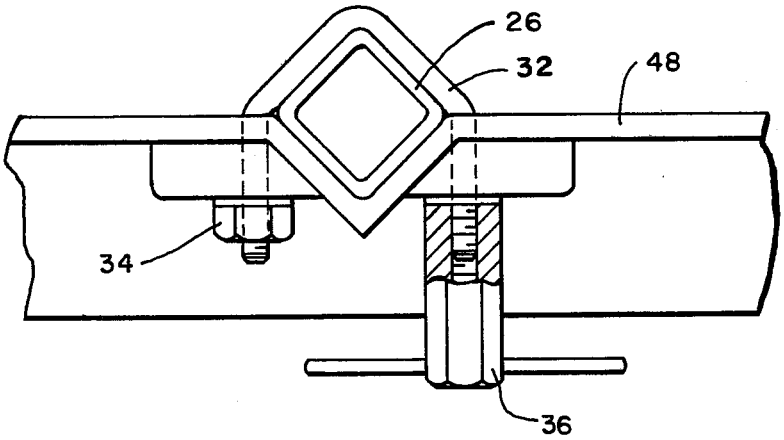
FIG. 3 is a partial top plan view of the present invention.

A guide frame 30 is adjustably mounted on the support posts 26. The guide frame is provided for the purpose of guiding the chain saw to cut a flat level track at a preselected depth in the log being sawed. A pair of clamps 32 are provided for mounting the guide frame on the support posts and in the preferred embodiment the clamps are a generally U-shaped bolt as shown in FIG. 3 and have thread on the free ends of the bolt. In operative position, the bolt closely surrounds the support post and the free ends extend through a portion of the guide frame with one end 34 being fixably bolted thereto and with the other end having an adjustable nut 36 whereby the clamp can be tightened or loosened by means of turning the adjustable nut.

The guide frame 30 includes a pair of flat bottomed slide members 38 which have vertical leading faces 40 and their bottom surfaces disposed in a plane which is parallel to the cutter bar 14. The bottom surfaces of the slide members are arranged to slide along the flat surface being used to guide the chain saw during the saw cut. This flat surface on an uncut log is usually a board nailed to the rounded outer surfce to provide the first flat guide surface. After the first cut has been taken to cut a round sided slab from the log a flat surface is formed upon the log which the guide frame travels along for the second cut. Thereafter, each successive cut leaves a flat surface upon which the guide frame slides.

The vertical leading faces 40 are perpendicular to the flat bottom surfaces of the slide members. The term, leading, means that surface which is disposed on the side of the guide frame slide member which faces the direction of travel of the saw through the cut. This leading face pushes the residual sawdust from in front of the slide members, either off the log or up over the slide member, to let the slide member guide along the flat surface of the saw cut.

The slide members 38 are pieces of material, in the preferred embodiment aluminum, cut from a length of extruded stock of uniform cross-section. In a preferred embodiment, the slide members are formed having a slot 42 extending along one side thereof and with a rectangular closed tubular section forming the remaining portion of the cross-section configuration. Bolt heads 44 may be slid into the slot with the bolt position 46 extending through the slot whereby the bolt heads are captured inside the slide member and can be moved to any position therealong to permit the securement of the slice member to other structure by means of the captured bolt.

The slide members 38 are interconnected by a pair of spreaders 48 which are secured to the pair of support posts 26. The slide members are disposed in parallel relation on opposite sides of the plane formed between the support posts, and the spreaders are adjustably clamped to the support posts by means of the previously described U-shaped bolts 32. The indicia 28 on the support posts is used to position the spreaders in variable positions an equal distance from the cutter bar to adjust for uniform depth of cut of the chain saw in the log.

An intermediate guide member 50 is disposed between the pair of spreaders 48 and generally parallel thereto. The intermediate guide membr is secured at its opposite ends to the slide members 38. In the preferred embodiment, the intermediate member is cut from the same stock as the slide members and then is bolted to a flat plate 52 by bolts 54 having the heads thereof captured in the slot formed on the intermediate member. The flat plate is in turn bolted by quick release wing nuts 56 to the slots in the slide members. This permits the intermediate guide member to be positioned at any location between the spreaders.

The intermediate guide member 50 provides a guide for the chain saw when it is first started in a cut or when it is finished a cut. At either of those times during the cutting operation, only one of the slide members 38 is in contact with the flat guide surface whereby the chain saw can be tipped up or down at an improper angle for making a straight and level cut. The intermediate guide member has its lower surface in the same plane with the pair of slide member whereby it contacts the flat surface when the cut is started or ended to help keep the chain saw flat during that portion of time when only one of the slide members is in contact with the guide surface.

The fact that the intermediate guide 50 and the slide members 38 are all cut from a uniform cross section piece of extruded material which basically is of hollow construction provides several advantages: A very minor amount of machining is necessary to manufacture those parts for the attachment. The pieces only need be cut off of the length of stock and then the cut ends polished smooth. Second, the fact the members are hollow permits a relatively lightweight construction which is important to the ease of operation of the device. The attachment has to be lifted from end to end of the log and then moved through it during the cut. For that reason, the weight of the apparatus is very important.

In the preferred embodiment, a guide fence 58 is provided which is formed from a pair of strips 60 of material which are of correspondingly bowed configuration. These strips are secured to the locking bars 16, 18 of the clamping means 12 at the drive end of the cutter bar 14. When cutting a board from a log, the action of the saw is to pull the drive end 62 of the chain saw into the wood as the saw chain travels through the wood. The guide fence bears against the outer surface of the log and rides along it as the chain saw travels the length of the log. This fence becomes very efficient if first a cut is made to form a first flat surface on the log and then a second cut is made at 90° to the first cut whereby a corner is formed on the log. Then the chain saw can be guided to cut the continuous boards using one flat side to guide along the fence and the other flat side to guide the depth of the cut underneath the slide members.

A chain guard 64 is provided which is removably securable to the clamping means 12 at the other end from the drive end 62 or at the race end 66 of the cutter bar 14. The race end is where the saw chain simply runs free in the track around the end of the cutter bar and returns to the drive end where the chain is powered. The chain guard is secured to the clamping means by a bolt 68 which extends through one of the locking bars and through holes 70 formed in the chain guard.

A handle 72 is provided which is secured to the guide frame 30 at the race end 66 of the cutter bar 14. In the preferred embodiment, the handle includes a structural member 74 which is secured to both of the spreaders 48 and interconnects them structurally for rigidity. A hand grip extends from the end of the structural member which is projecting outward from the spreader at the race end of the cutter bar. The operation of the log sawing attachment requires two people to move the chain saw through the wood. One operator works the chain saw drive motor and the other person grips the handle and helps pull the free end of the chain saw through the wood.

The device of the present invention is constructed from relatively inexpensive materials. The locking bars, the slide bars and the intermediate guide bar and the support bars are all made from uniform cross section cut lengths of extruded stock material. The spreaders can be cast pieces or possibly stamped items. The extensive use of the simple materials permits low cost for parts and easy assembly. The use of hollow parts permits lightweight strong structure making the device easy to handle and cheaper to construct. The unique design of the attachment permits mounting on the cutter bar without modifications and therefore makes the present invention one which is easily adaptable to a chain saw in the field.

The combined advantages of lightweight inexpensive construction, and no need of modification of the cutter bar for assembly, make this new improvement in the field of log sawing attachments one of the least expensive and most efficient units available for sawing logs into boards. It is therefore obvious that the invention can achieve all the objects attributable thereto, and while the invention has been described in considerable detail, it is not to be limited to such details except as may be necessitated by the appended claims.

I claim:

1. A log sawing attachment for chain saw comprising a pair of clamping means for engaging opposite ends of the cutter bar of a chain saw, each of said clamping means being formed with a pair of locking bars which extend beyond the edges of the cutter bar and saw chain and are adjustably interconnected at their opposite ends outside the chain path permitting the locking bars to be drawn together to clamp the chain saw cutter bar therebetween, a pair of support posts, each of said posts being secured to one of said clamping means and disposed to project perpendicularly from said cutter bar on the same side thereof, a guide frame adjustably mounted on said support posts for guiding the chain saw to cut at a preselected depth in the log being sawed, said guide frame including a pair of flat bottomed slide members having their bottom surfaces disposed in a plane parallel said cutter bar and which slide along the flat surface being used to guide the chain saw during the saw cut, said slide members being interconnected by a pair of spreaders and disposed in parallel relation on opposite sides of a plane formed between said support posts, said spreaders being adjustably clamped to said support posts to permit variable spacing of the guide frame with respect to the chain saw cutter bar, a guide fence secured to the clamping means disposed at the drive end of the cutter bar, and a handle secured to said guide frame disposed on the race end of the cutter bar.

2. The log sawing attachment of claim 1 wherein the locking bars are square tubular members having pressure pads secured thereto intermediate the ends thereof on the opposing surfaces for gripping the chain saw cutter bar therebetween and to provide clearance for the saw chain between the locking bars.

3. The log sawing attachment of claim 1 wherein the support posts are square tubular members and have indicia imprinted thereon to permit alignment of the guide frame on the support posts.

4. The log sawing attachment of claim 1 wherein the guide frame includes an intermediate guide member disposed between said pair of spreaders and adjustably secured at its opposite ends between said slide members.

5. The log sawing attachment of claim 1 wherein said flat bottomed slide members are of a hollow construction for light weight and are cut from a length of extruded stock material.

6. The log sawing attachment of claim 5 wherein said extruded stock material has a square cross-section and includes a slot extending along one side thereof whereby bolt heads may be captured inside said length of stock material and moved to any position therealong.

7. The log sawing attachment of claim 1 including a chain guard removeably securable to the clamping means disposed closest to the race end of said cutter bar.

8. The log sawing attachment of claim 1 wherein said handle includes a structural member which is secured to both of said spreaders and the handle extends from the end of said structural member disposed proximate the race end of the cutter bar.

9. The log sawing attachment of claim 1 wherein said guide fence is formed from a pair of strips of material of similar bowed configuration, each of said strips being secured to one of said locking bars.

10. A log sawing attachment for a chain saw comprising a pair of clamping means for engaging opposite ends of the cutter bar of a chain saw, each of said clamping means being formed with a pair of locking bars which extend beyond the edges of the cutter bar and saw chain and are adjustably interconnected at their opposite ends outside the chain path permitting the locking bars to be drawn together to clamp the chain saw cutter bar therebetween said locking bars being square tubular members having pressure pads secured thereto intermediate the ends and on opposing surfaces thereof for gripping the chain saw cutter bar therebetween and by means of their thickness to provide clearance for the saw chain between the locking bars, a pair of square tubular support posts having corresponding indicia printed thereon each of said posts being secured to one of said clamping means and disposed to project perpendicularly from said cutter bar on the same side thereof, a guide frame adjustably mounted by means of clamps on said support posts for guiding the chain saw to cut at a preselected depth in the log being sawed, said guide frame including a pair of square tubular slide members having their bottom surfaces disposed in a plane parallel said cutter bar and which slide along the flat surface being used to guide the chain saw during the saw cut, said slide members being cut from a length of extruded stock material of uniform cross-section and having a slot extending along one side thereof whereby bolt heads may be captured inside thereof and moved to any position therealong, said slide members being interconnected by a pair of spreaders and disposed in parallel relation on opposite sides of the plane formed between said support posts, said spreaders being adjustably clamped to said support posts to permit variable spacing of the guide frame with respect to the chain saw cutter bar, an intermediate guide member disposed between said pair of spreaders on said guide frame and adjustably secured at its opposite ends between said slide members.

a guide fence formed from a pair of strips of material of correspondingly bowed configuration secured to the clamping means disposed at the drive end of the cutter bar, each of said strips being secured to one of said locking bars, a chain guard removeably securable to the clamping means disposed closest to the race end of said cutter bar, and a handle secured to said guide frame disposed on the race end of the cutter bar, said handle including a structural member which is secured to both said spreaders and a hand grip extends from the end of said structural member disposed proximate the race end of the cutter bar.

* * * * *